US006763755B2

(12) United States Patent
Johnson

(10) Patent No.: US 6,763,755 B2
(45) Date of Patent: Jul. 20, 2004

(54) EXTENDED LEVER FOR A FIREARM

(76) Inventor: David A. Johnson, P.O. Box 12517, Salem, OR (US) 97309

( * ) Notice: Subject to any disclaimer, the term of this patent is extended or adjusted under 35 U.S.C. 154(b) by 0 days.

(21) Appl. No.: 10/444,255

(22) Filed: May 23, 2003

(65) Prior Publication Data

US 2003/0208941 A1 Nov. 13, 2003

Related U.S. Application Data

(62) Division of application No. 10/142,474, filed on May 10, 2002.

(51) Int. Cl.[7] ..... F41C 27/00
(52) U.S. Cl. ..... 89/1.42; 42/90
(58) Field of Search ..... 89/1.42, 1.4; 42/90, 42/98

(56) References Cited

U.S. PATENT DOCUMENTS

| | | | | | |
|---|---|---|---|---|---|
| 2,130,383 | A | | 9/1938 | End | 42/3 |
| 2,289,067 | A | | 7/1942 | Owsley | 42/50 |
| 2,710,476 | A | | 6/1955 | Garand | 42/18 |
| 3,191,332 | A | | 6/1965 | Ardolino | 42/50 |
| 3,386,336 | A | * | 6/1968 | Roy | 89/128 |
| 3,623,256 | A | | 11/1971 | Shiplee, III | 42/50 |
| 3,733,728 | A | * | 5/1973 | Kuslich | 42/98 |
| 3,755,946 | A | * | 9/1973 | Tomlinson et al. | 42/106 |
| 4,057,003 | A | * | 11/1977 | Atchisson | 89/138 |
| 4,100,694 | A | | 7/1978 | Musgrave | 42/90 |
| 4,115,943 | A | | 9/1978 | Musgrave | 42/90 |
| 4,226,041 | A | | 10/1980 | Goodworth | 42/50 |
| 4,455,776 | A | * | 6/1984 | Ashley et al. | 42/124 |
| 4,484,404 | A | | 11/1984 | Johnson | 42/90 |
| 4,565,113 | A | * | 1/1986 | Bunning | 89/1.4 |
| 4,628,627 | A | | 12/1986 | Johnson | 42/90 |
| 4,903,426 | A | * | 2/1990 | Bammate | 42/98 |
| 5,279,059 | A | | 1/1994 | Howard | 42/90 |
| 5,519,954 | A | * | 5/1996 | Garrett | 42/6 |
| 5,636,465 | A | * | 6/1997 | Johnson | 42/90 |
| 5,749,166 | A | * | 5/1998 | Brooks | 42/70.11 |
| 5,934,002 | A | * | 8/1999 | Blanchet | 42/98 |
| 6,530,169 | B1 | * | 3/2003 | Griffin | 42/98 |

FOREIGN PATENT DOCUMENTS

| | | | |
|---|---|---|---|
| FR | 888.965 | * 12/1943 | 89/1.42 |

OTHER PUBLICATIONS

J.F.S., Inc., Boonie Packer Tactical and Range Accessories, Dec. 1995—note description beneath "Redi–Mag" heading; 2 pages.

Michaels of Oregon Co.'s "Uncle Mike's" Product Catalog, page number unknown, 1993; 2 pages.

* cited by examiner

*Primary Examiner*—Stephen Johnson
(74) *Attorney, Agent, or Firm*—Chernoff, Vilhauer, McClung & Stenzel, LLP

(57) ABSTRACT

An extender for a bolt catch release lever on a bolt catch operating lever of a firearm equipped with a protective spare magazine carrier for holding a loaded spare magazine in a position of readiness for immediate insertion into operative engagement with that firearm, and an integrated bolt catch and extended catch release lever. The extended bolt catch release lever places an engagement contact face of an outer end in a position accessible for easy operation of the bolt catch release mechanism of a rifle when the spare magazine carrier is in place.

17 Claims, 4 Drawing Sheets

EXTENDED LEVER FOR A FIREARM

CROSS REFERENCE TO RELATED APPLICATIONS

This application is a division of U.S. patent application Ser. No. 10/142,474, filed May 10, 2002.

BACKGROUND OF THE INVENTION

The present invention relates to repeating firearms, and particularly to a repeating firearm using a replaceable magazine.

In land warfare the individual infantry soldier is still an important part of military operations. The effectiveness of the individual soldier depends to a large extent on the accuracy, rate of fire, and number of rounds of ammunition which each individual soldier is capable of providing. For that reason, modern infantry firearms are capable of high cyclic rates of fire and are usually equipped with replaceable magazines capable of holding dozens of cartridges. Such magazines must usually be manually released from the firearm when they have become empty, at which time a full magazine must be inserted into the firearm before firing may be continued. In order to be capable of sustained firing an infantry soldier carries loaded spare magazines, typically held in protective pouches attached to ammunition belts. When actually engaged in combat it is common for soldiers to carry spare loaded magazines more immediately ready for use, since removal of a loaded magazine from a cartridge belt may take an undesirably long time.

In order to provide an ability to fire more rounds quickly, spare magazine carriers as disclosed in Johnson U.S. Pat. Nos. 4,484,404 and 5,636,465, of which the disclosures are hereby incorporated herein by reference, allow a spare magazine to be carried alongside the receiver of a rifle, ready for immediate use. However, the device disclosed in the mentioned Johnson U.S. Patents may limit access to a functional operating lever or button located on the receiver of certain rifles. In particular, the spare magazine carrier shown in the U.S. Pat. No. 4,484,404 is located close to one part of a bolt catch operating lever on certain auto-loading rifles such as M-16 military rifles and Colt® AR15 rifles. This closeness to the bolt catch operating lever requires use of a certain amount of a soldier's attention to push the bolt catch operating lever to release the bolt and chamber a round from a newly inserted magazine in such a rifle. With the spare magazine carrier in place, the rifleman must exercise additional care and use a finger or the thumb to locate and definitely push the upper end of the bolt catch operating lever toward the receiver to release the bolt. While the time involved in doing so may be well less than a second, the action may require the rifleman to look at the bolt catch operating lever at a critical time, thus dangerously distracting his attention. Releasing the bolt of such a firearm upon replacing the magazine thus may require a critically important additional amount of time during combat. It is therefore desired to provide a way to improve the speed and efficiency of reloading and resuming operation of the firearm with which a spare magazine carrier is associated, without detracting from any other aspects of the firearm.

What is needed, then is a device which can be readily installed to facilitate operation of an operating control device such as a bolt catch operating lever and which fits in the available space adjacent the weapon when an accessory such as a spare magazine carrier is installed.

SUMMARY OF THE INVENTION

The present invention supplies an answer to the aforementioned need for a fast and efficient way to reload and resume firing a firearm such as an automatic or semiautomatic firearm equipped with a spare magazine carrier mounted alongside the receiver of such a firearm. The present invention provides an improved bolt catch operating lever and an operating control device extender useful with an existing bolt catch operating lever or other operating control lever or button located on the firearm where a spare magazine carrier or similarly located accessory may interfere with it.

In one embodiment of the invention the operating control device extender has a leg including a head with an engagement contact face available near an outer face of an installed accessory such as a spare magazine carrier, where it can easily be pushed toward the receiver of the firearm on which the accessory is mounted, to move an operating control device such as a button or lever located on the receiver of the firearm.

It is a feature of one embodiment of the invention that it includes a clamp that securely attaches the extender to a bolt catch operating lever and retains the extender securely on the lever even if the clamp, through extended use, becomes slightly loosened.

In one embodiment of the invention, a bolt catch operating lever includes an integral extension and can be used to replace an original bolt catch operating lever of such a firearm.

It is a feature of one embodiment of the extender that it includes a positive stop to prevent an operating control lever from being bent or broken.

The foregoing and other objectives, features and advantages of the present invention will be more readily understood upon consideration of the following detailed description of the invention taken in conjunction with the accompanying drawings.

DETAILED DESCRIPTION OF THE PREFERRED EMBODIMENT

Figure 1:
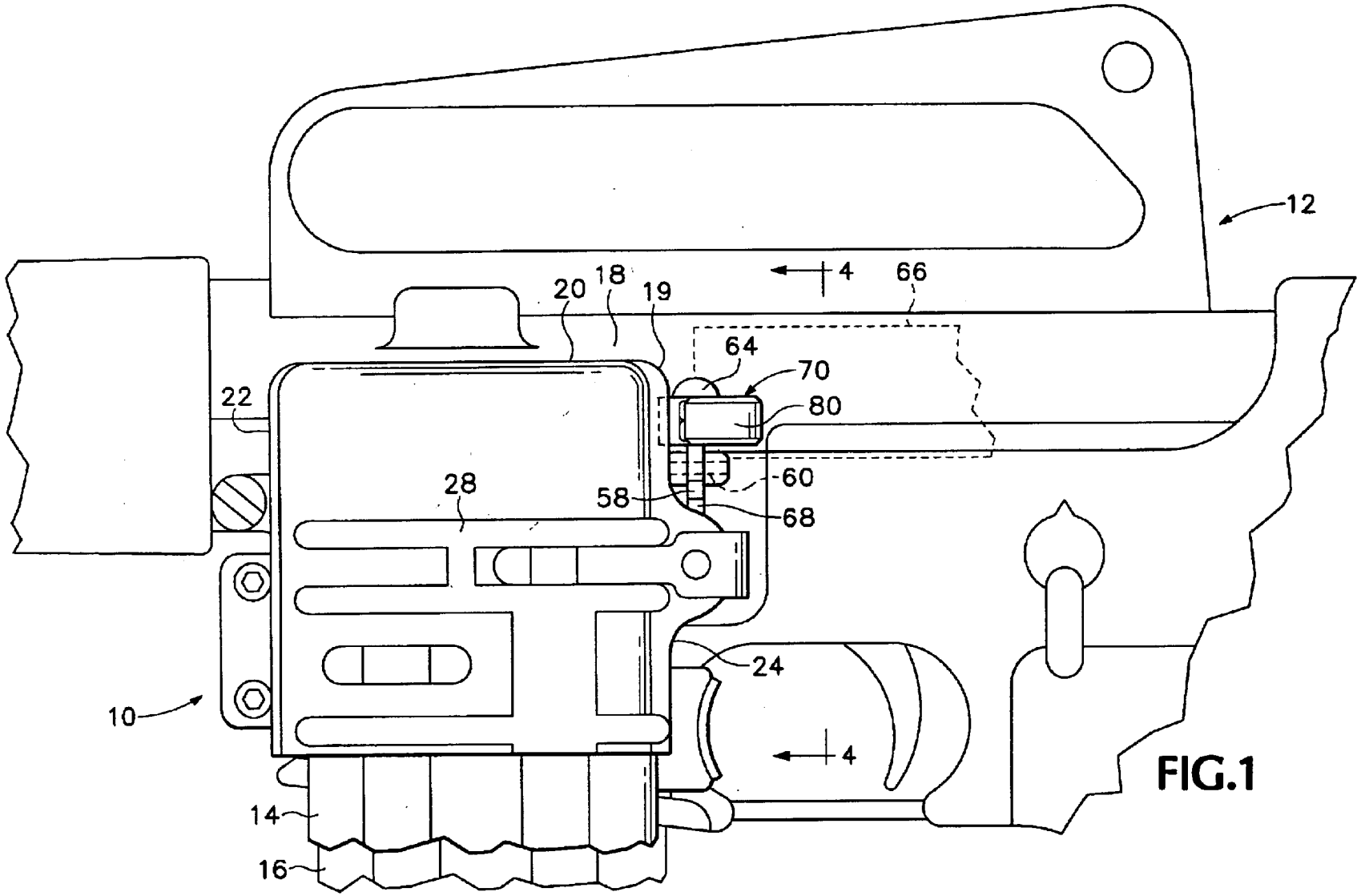
FIG. 1 is a left side elevational view of a portion of an automatic rifle together with an attached protective carrier for a spare magazine and with an extender embodying the present invention attached to a bolt catch operating lever on the rifle.
Figure 2:
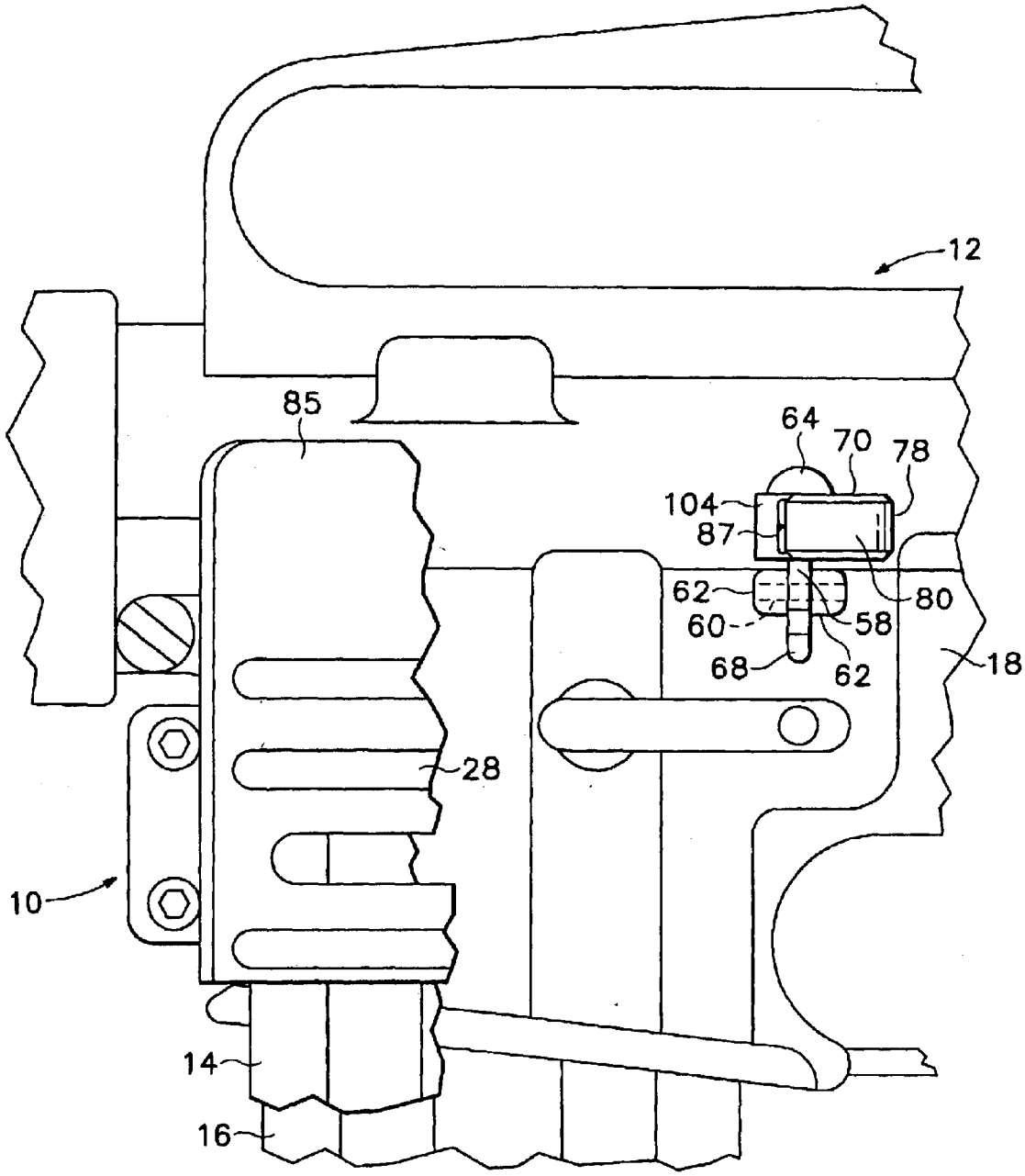
FIG. 2 is a view similar to a portion of FIG. 1, at an enlarged scale, showing the spare magazine carrier partially cut away.

Referring now to FIGS. 1 and 2 of the drawings, an exemplary spare magazine carrier 10 is shown attached to an automatic rifle 12. A spare magazine 14 is held in the carrier 10, while a magazine 16 is held in the receiver 18 of the automatic rifle 12, ready for use. The spare magazine carrier 10 includes a body 19 having a top 20, a front side 22, a rear side 24, a right, or inner, side 26, and a left, or laterally outer, side 28, spaced outwardly apart from the left side of the receiver 18 by a width 30.

To use the spare magazine carrier 10 most advantageously, a shooter will grasp the spare magazine 14 in his left hand while moving the magazine-release push button on the right side of the receiver (not shown) leftward with his right hand. This allows the empty magazine 16 to fall from the receiver 18 and releases the spare magazine 14 into the shooter's left hand, so that he may immediately insert the spare magazine 14 upwardly into position in the receiver 18. A magazine retaining catch of the automatic rifle 12 engages and retains the spare magazine 14 as it is inserted into position in the receiver 18. As a result of the readily available spare magazine 14, the automatic rifle 12 may be reloaded extremely quickly once the magazine 16 has been emptied. Another loaded magazine may thereafter be inserted into the spare magazine carrier 10 at the first convenient opportunity.

Certain rifles, for example the M-16 military automatic rifle and a similar civilian semi-automatic rifle, the Colt® AR15 rifle, like the rifle 12 shown in FIGS. 1 and 2, may include push-buttons or levers which act as functional control devices to initiate, prevent, or stop the action of mechanisms contained within the receiver of such rifles. Some of such push-buttons or levers may be located on the left side of the receiver 18 where the body 19 of the spare magazine carrier 10 may make it awkward, or may require close attention, to operate such push-buttons or levers.

In particular, in the rifle 12 there is a bolt catch operating lever 58, also called a bolt hold-open lever, attached to the left side of the receiver 18 by, and arranged to pivot about, a pin 60 extending parallel with the length of the rifle 12. The pin 60 extends through a hole 61 in the bolt hold-open lever 58, defining its fulcrum, and through a pair of gudgeons 62 on the side of the receiver 18. When the upper end 64 of the bolt hold-open lever 58 is moved away from the receiver 18, with the bolt 66 manually held withdrawn rearwardly with respect to the receiver 18, as shown schematically in broken line in FIG. 1, the bolt catch in the hold-open mechanism engages the bolt 66 to hold it in its rearward position. When the upper end 64 of the bolt hold-open lever 58 is pressed to the right, or inward toward the receiver 18, the catch is disengaged and releases the bolt 66 to be moved forward by a spring.

When the last cartridge that was contained in a magazine such as the magazine 16 has been discharged, the bolt hold-open mechanism automatically engages the bolt 66, holding it in its rearward position. The bolt 66 is thus held rearward while the empty magazine 16 is removed and replaced by the spare loaded magazine 14. Before the rifleman can again shoot the firearm, the bolt 66 must be released by moving the bolt hold-open lever 58, so the bolt can carry a round from the loaded magazine into the chamber of the firearm.

In order to make it unnecessary for the rifleman to look at the upper end 64 of the bolt hold-open lever, an extender 70 according to the present invention is attached to the upper end 64 of the bolt hold-open lever 58, as shown in FIGS. 1–4. The extender 70 includes an elongate body 72 whose inner end is attached to the upper end 64 of the bolt hold-open lever 58 by a clamp 74.

Without the spare magazine carrier 10 attached to the rifle 12, the lower end 68 of the bolt hold-open lever 58 is ordinarily available to be pushed inward toward the receiver 18 to cause the bolt hold-open lever 58 to pivot about the pin-60 to engage the catch of the bolt hold-open mechanism with the bolt 66. The availability of the lower end 68 to be pushed is particularly useful when the user of the rifle is wearing gloves, since the upper end 64 is too small and too close to the receiver 18 to be grasped easily by a gloved hand to withdraw it away from the receiver 18. When the spare magazine carrier 10 is present, however, the lower end 68 is not easily reached to be pushed. The bolt catch or hold-open mechanism can easily be engaged with the bolt 66 to hold the bolt open, by pushing downward on the extender 70 when a spare magazine carrier 10 is mounted on the rifle 12.

The elongate body 72 includes an extension arm 76 directed away from the receiver 18. An enlarged head 78 forms the outer end of the extender 70 and has an engagement contact face 80, spaced apart by a distance 82 from a reference face 81 engaged with the upper end 64, and spaced apart from the left side of the receiver 18 by a predetermined distance 83 somewhat less than the width 30 of the spare magazine carrier 10. The engagement contact face 80 is thus substantially aligned with the left or laterally outer side 85 of a nearby somewhat narrower portion of the spare magazine carrier 10, and thus is located closer to the left side of the receiver 18 by a small distance 89 in the range of 0.2–0.6 cm (0.08–0.24 inch) and preferably in the range of 0.38–0.51 cm (0.15–0.20 inch) toward the receiver 18 from the outermost surface of the laterally outer, or left, side 28 of the spare magazine carrier 10. The outer surface or engagement contact face 80 of the head 78 of the extender 70 is thus exposed conveniently in a location where it can be pressed inward toward the receiver 18 by the rifleman, using the heel of his hand, after he has pushed the loaded spare magazine 14 into the receiver 18 of the rifle 12. At the same time, the head 78 of the extender 70 is not so prominent as to be likely to be pushed inadvertently. In an extender 70 for an M-16 rifle with a spare magazine carrier 10, the distance 82 should thus be in the range of 1.90–2.54 cm (0.750–1.0 inch) and is preferably 1.97 cm (0.775 inch).

Pushing on the engagement contact face 80 of the extender 70 requires only a minimum amount of attention, since the engagement contact face 80, which is larger than the ear 96 on the upper end 64 of the bolt hold-open lever 58, is well exposed to be contacted and pushed by the rifleman, even if his left hand is gloved. Since the engagement contact face 80 is exposed, the rifleman does not need to exercise any particular care or give any particular attention, but needs only to sweep the left hand upward and inward to easily touch the extender 70 and push it inward, thus disengaging the catch mechanism from the bolt 66. Since the extender 70 protrudes outward away from the receiver 18, pushing upward on the bottom face 84 of the extender 70 will also cause the bolt hold-open lever 58 to rotate about the fulcrum defined by the pivot pin 60, in the same direction that would result from inward pressure against the upper end 64. Thus, the rifleman need only continue upward movement of the left hand after inserting the loaded magazine into the receiver 18, with very little attention required in order to engage and move the extender 70 and thus move the bolt hold-open lever 58 as required to chamber a cartridge from a just-inserted magazine 14.

In a preferred embodiment of the invention, as shown also in FIGS. 5–8, the extender 70 includes two pieces held together by a bolt 86 and a locknut 87. A main body piece 88 includes the head 78 and has a front face 90 in which a groove 92 extends most of the way toward the bottom face 84 of the body 72. A retaining shelf or ledge 94 shown in FIGS. 7 and 8 at least partially closes at the bottom of the groove 92 and extends beneath a portion of the bottom of the ear portion 96 of the upper end 64 of the bolt hold-open lever 58. The location of the ledge 94 in the main body 88 of the extender rather than in the clamping body 98 simplifies attachment of the extender 70 to the upper end 64 when a spare magazine carrier 10 is already in place on the rifle 12.

Figure 8:
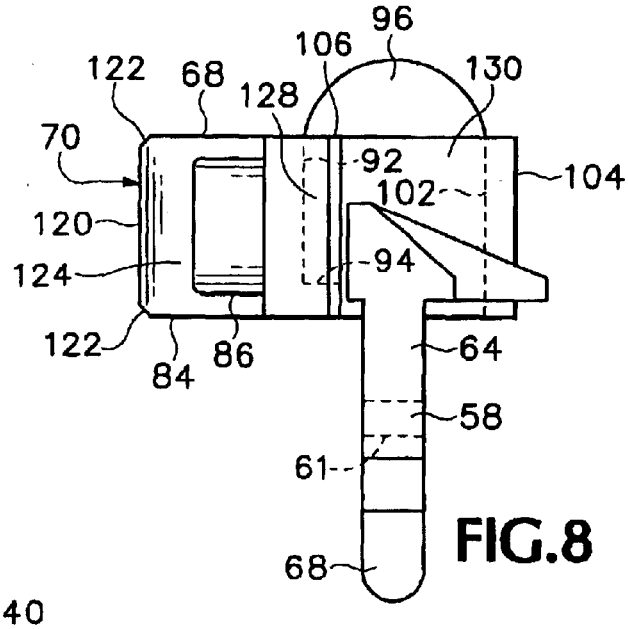
FIG. 8 is a right, or inner, end elevation view of the extender together with the bolt catch operating lever, taken in the direction of line 8—8 of FIG. 6.

The clamping body 98 has a main or inner face 100 opposing the front face 90 of the first body 88 and defines a deep groove 102 in an inner end portion 104. The lack of a ledge 94 in the groove 102 in the clamping body 98 allows the clamping body 98 to slide down around the ear 96. The deep groove 102 is deep enough to receive the majority of the width of the ear 96, but shallow enough so that a small gap 106 remains as shown in FIG. 8 when the ear 96 is tightly held between the clamping body 98 and the main body part 88 of the extender 70. The bolt 86 extends through aligned bores 110 and 112 defined through the main body 88 and the clamping body 98, and the locknut 87 fits in a wide groove 116 defined on the front face of the clamping body 98. The width of the wide groove 116 corresponds with the width across flats of the locknut 87 to prevent the locknut 87 from turning while the bolt 86 is screwed into the locknut 87. The clamping body 98 has an outer end face 118 that abuts tightly against a flat clamp body locating face 119 on the inner side of the head 78 to maintain the alignment of the clamping body with the main body of the extender 70.

Preferably, the rear end 120 and the edges 122 of the head 78 are rounded or chamfered to prevent the head 78 from causing discomfort when it is pressed or hit during use. A hole 123 may be provided in the head 78 to lighten the extender 70. An inner rear or transition face 124 of the head 78, between the engagement contact face 80 and the extension arm portion 76, is oriented at an oblique angle 126 (FIG. 3), which may be in the range from 30 to 60 degrees and is preferably at least 40 degrees, and most preferably about 45 degrees to the engagement contact face. This helps prevent the extender 70 from being caught on the rifleman's clothing or equipment.

The thickness 132 of the portions 128 and 130 behind the ear 96 is limited by the available space behind the ear 96 in order to leave the bolt hold-open lever 58 free to move far enough to release the bolt 66. The thickness 132 is preferably made nearly as great as possible, so that the portions 128 and 130 occupy the entire available space between the ear 96 and the adjacent portion of the receiver 98 when the bolt hold-open lever 58 is pushed far enough toward the receiver 18 to release the bolt 66. The portions 128 and 130 of the extender 70 thus act as a positive stop to protect the bolt hold-open lever 58 from being damaged as a result of the forces that may result from pushing sharply up or inward on the extender 70 after inserting a loaded magazine 14 into the receiver 18.

Figure 3:
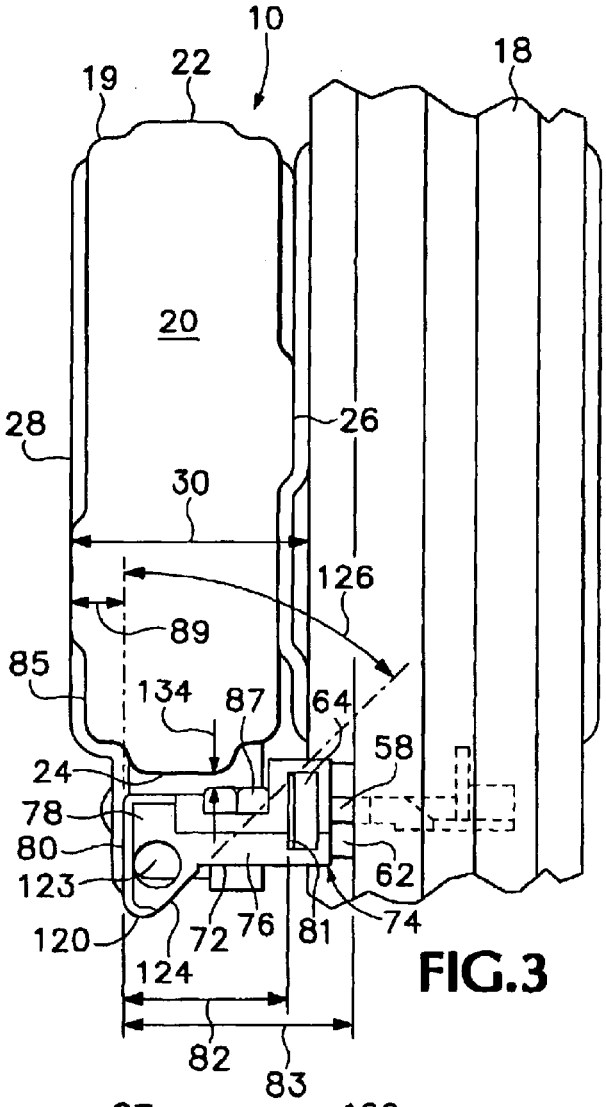
FIG. 3 is a top plan view of the spare magazine carrier, a portion of the receiver of the rifle, and the extender.
Figure 4:
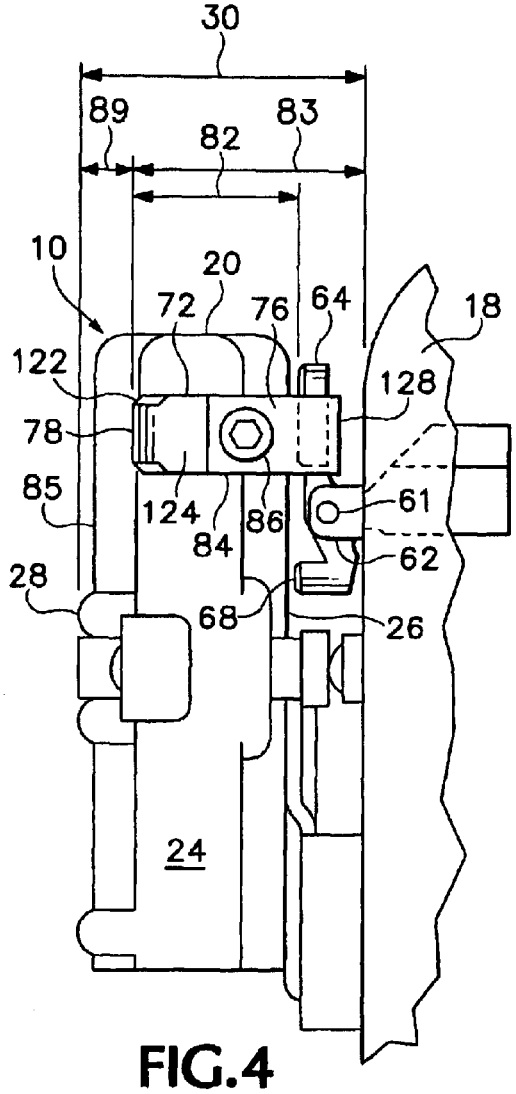
FIG. 4 is a view of a portion of the rifle with the extender in place, taken along line 4—4 of FIG. 1.
Figure 5:
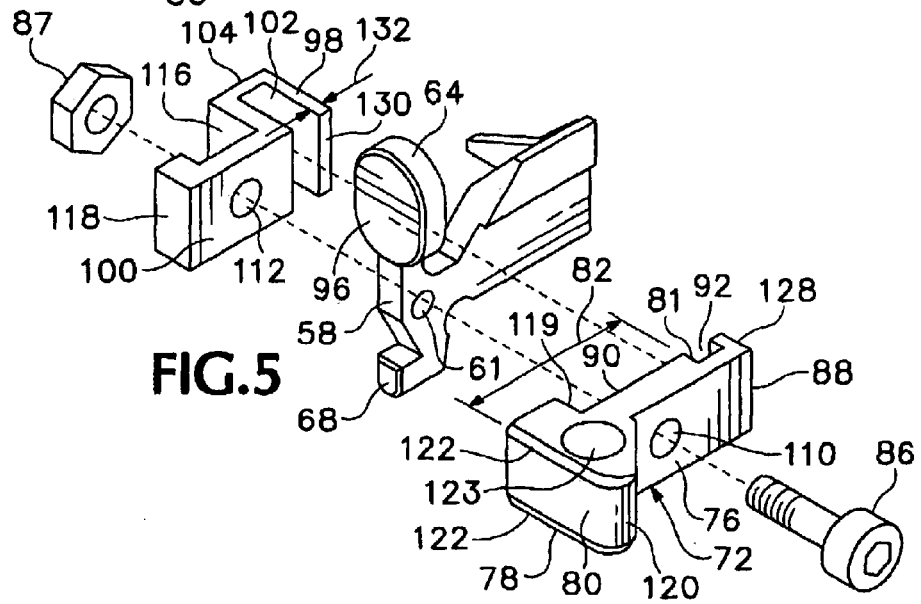
FIG. 5 is an exploded isometric view of the extender shown in FIGS. 1–4 together with the bolt catch and its operating lever.
Figure 6:
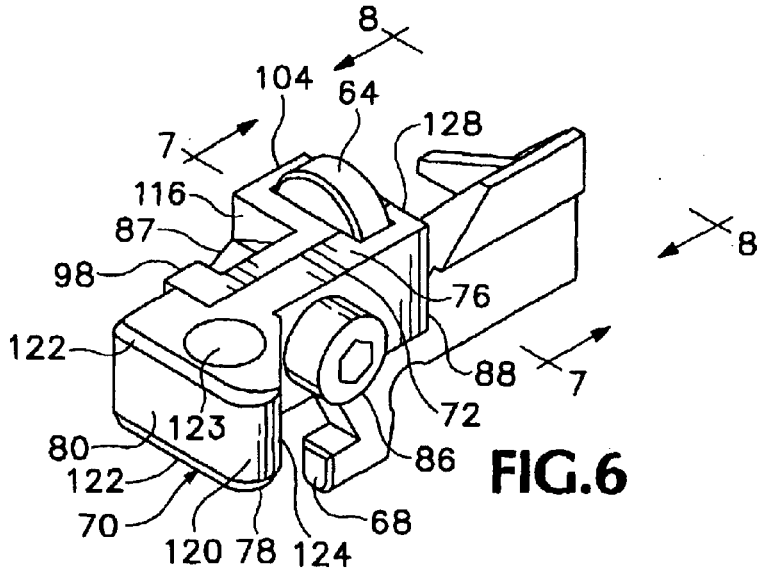
FIG. 6 is an isometric view from the upper left rear, showing the extender in place on the operating lever of the bolt catch.
Figure 7:
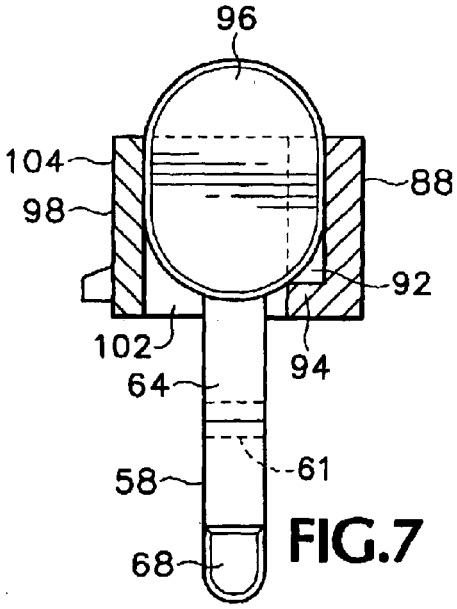
FIG. 7 is a sectional view of the extender in place on the bolt catch operating lever, taken along line 7—7 of FIG. 6.

The extender 70 is offset a slight distance rearwardly with respect to the bolt hold-open lever 58, as seen best in FIG. 3, in order to provide clearance between the rear of the spare magazine carrier 10 and the front of the extender 70, as shown best in FIG. 3, where a space 134 of at least 1.27 mm (0.050 inch) is preferably available.

It will be understood that other clamping mechanisms may be used instead of the particular one discussed herein above to attach an extension arm to the upper end of the bolt catch operating lever 58. For example, a set screw could be used with a one-piece extender, two clamping elements could be arranged to grip the inner and outer faces of the ear 96, or a wedging arrangement could be included.

Figure 9:
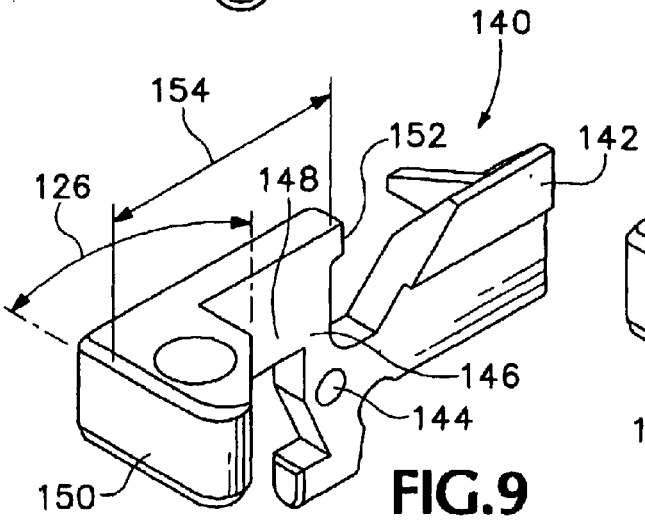
FIG. 9 is an isometric view of a combined bolt catch and extended operating lever which is an alternative embodiment of the present invention, taken from the upper left rear thereof.
Figure 10:
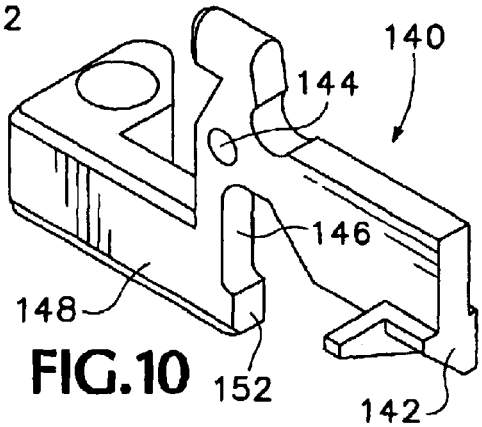
FIG. 10 is an isometric view of the combined bolt catch and extended operating lever shown in FIG. 9, taken from the lower right front thereof.

Referring now also to FIGS. 9 and 10, it will be seen that an extender arm can be incorporated in a replacement bolt hold-open catch mechanism 140 that can be installed in a firearm in place of the original equipment bolt hold-open catch mechanism including the bolt catch operating lever 58 when installing a spare magazine carrier 10. The bolt hold-open catch 140 can be installed in place of the original bolt catch and operating lever 58 by simply drifting out the pin 60 from the gudgeons 62, preferably before installing a spare magazine carrier 10.

In such a replacement part, the usual bolt-engaging catch body 142 and a hole 144 establishing a fulcrum are as in the original part, and an actuating lever arm 146 extends away from the catch body 142 for a short distance in the same direction as the upper portion 64 of the bolt hold-open lever 58. An extension arm 148 is directed laterally, approximately perpendicular to the actuating lever arm 146, so that it extends away from the receiver 18 when the part 140 is installed in place of the original part including the catch operating lever 58. As in the previously described extender 70, the extension arm 148 includes an enlarged head, which has an engagement contact face 150 located in a position corresponding with that of the engagement contact face 80 of an extender 70 installed on the bolt hold-open lever 58. The engagement contact face 150 is thus spaced apart from a plane parallel to the left side of the receiver and including the fulcrum 144 by a distance 154 of about 1.0–3.5 cm (0.39–1.38 inch) and preferably 2.2–3.0 cm (0.87–1.2 inch), and most preferably about 2.35 cm (0.92 inch), in particular for an M-16 rifle equipped with a "Redi-Mag"™ spare magazine carrier of the type available from J.F.S., Inc. of Salem, Oreg. Preferably, the actuating lever arm 146 includes a positive stop 152 at the inner end of the laterally projecting extension arm 148.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A bolt catch operating lever, in combination with a firearm, said firearm having a receiver including a side, said firearm also having an accessory mounted against said side of receiver and said accessory having a width and an outer face spaced apart from said side of said receiver by said width, said bolt catch operating lever including an arm having its longest dimension extending laterally outwardly from said side, said arm having an outer end and an engagement contact face located at said outer end and oriented parallel with said side, and said engagement contact face being spaced apart from said side of said receiver by a predetermined distance.

2. The combination of claim 1, said arm further including an enlarged head at said outer end thereof, said engagement contact face being located on said head.

3. The combination of claim 2, including a transitional face located between said engagement contact face and a portion of said arm located closer to said side, said transitional face being oriented at an angle of at least 30 degrees to said engagement contact face.

4. The combination of claim 1, including a positive stop associated with an inner end of said arm for limiting movement of said bolt catch operating lever toward said receiver.

5. The combination of claim 1 wherein said predetermined distance is about equal to said width.

6. The combination of claim 1 wherein said predetermined distance is no greater than said width.

7. The combination of claim 1 wherein said predetermined distance is less than said width.

8. The combination of claim 1 wherein said predetermined distance is in the range of 0.2–0.5 cm less than said width.

9. An operating control device extender in combination with a firearm including a receiver able to hold a magazine in a position of operative engagement therein, said receiver having a side and said firearm including an operating control device located on said side of said receiver, a spare magazine carrier having a width being mounted on said firearm adjacent said side of said receiver for carrying a loaded spare magazine for said firearm in addition to any magazine already in a position of operative engagement in said receiver, said operating control device extender comprising:

an arm attached to said operational control device and having its longest dimension extending laterally adjacent said spare magazine carrier, said arm having an outer end including an engagement contact face oriented parallel with said side of said receiver and spaced apart therefrom by a predetermined distance.

10. The combination of claim 9, said extender including an enlarged head at said outer end of said arm, said engagement contact face being located on said head.

11. The combination of claim 9, including a transitional face located between said engagement contact face and a portion of said arm and oriented at an angle of at least 30 degrees to said engagement contact face.

12. The combination of claim 9 wherein said predetermined distance is about equal to said width.

13. The combination of claim 9 wherein said predetermined distance is no greater than said width.

14. The combination of claim 9 wherein said predetermined distance is slightly less than said width.

15. The combination of claim 14 wherein said predetermined distance is in the range from 2–10 mm less than said width.

16. An operating lever, in combination with a firearm, said firearm having a receiver including a side, said firearm also having an accessory mounted against said side of receiver and said accessory having a width and an outer face spaced apart from said side of said receiver by said width, said operating lever pivoting about a fulcrum having an axis parallel to said side of said receiver and said operating lever including an arm extending laterally outwardly from said side, said arm having an outer end and an engagement contact face located at said outer end and oriented parallel with said side of said receiver, and said engagement contact face being spaced apart from said fulcrum by a predetermined distance of at least 1 cm.

17. An operating lever, in combination with a firearm, said firearm having a receiver including a side, said firearm also having an accessory mounted against said side of receiver and said accessory having a width and an outer face spaced apart from said side of said receiver by said width, said operating lever including an arm extending laterally outwardly from said side, said arm having an outer end and an engagement contact face located at said outer end and oriented parallel with said side, and said engagement contact face being spaced apart from said side of said receiver by a predetermined distance in the range of 0.2–0.5 cm less than said width.

* * * * *